US007453469B2

(12) United States Patent
Stevenson et al.

(10) Patent No.: US 7,453,469 B2
(45) Date of Patent: Nov. 18, 2008

(54) SLOW DITHER DISPLAY

(75) Inventors: Paul E. Stevenson, Colorado Springs, CO (US); Richard A. Klinger, Colorado Springs, CO (US)

(73) Assignee: Intel Corporation, Santa Clara, CA (US)

( * ) Notice: Subject to any disclaimer, the term of this patent is extended or adjusted under 35 U.S.C. 154(b) by 259 days.

(21) Appl. No.: 11/024,556

(22) Filed: Dec. 28, 2004

(65) Prior Publication Data

US 2006/0139363 A1 Jun. 29, 2006

(51) Int. Cl.
*G09G 5/02* (2006.01)

(52) U.S. Cl. ..... 345/596; 345/581; 345/599; 345/603; 348/556; 348/574

(58) Field of Classification Search ..... 345/581, 345/598, 599, 603, 596; 348/173, 174, 443, 348/445, 454, 509, 555, 556, 558, 574, 640, 348/641, FOR. 146; 358/3.13, 3.14, 3.16, 358/3.19

See application file for complete search history.

(56) References Cited

U.S. PATENT DOCUMENTS 4,543,599 A * 9/1985 Willis et al. ..... 348/574
4,670,784 A * 6/1987 Goldberg ..... 348/556
4,928,182 A * 5/1990 Guerinot et al. ..... 348/818
6,262,772 B1 * 7/2001 Shen et al. ..... 348/445
6,982,722 B1 * 1/2006 Alben et al. ..... 345/596
2002/0154137 A1 * 10/2002 Ben-David ..... 345/596
2003/0071769 A1 * 4/2003 Sullivan et al. ..... 345/63

* cited by examiner

*Primary Examiner*—Matthew C. Bella
*Assistant Examiner*—Gregory F Cunningham
(74) *Attorney, Agent, or Firm*—Molly A. McCall

(57) ABSTRACT

Embodiments of the invention provide an image display mode for displays, such as a television, that do not use the entire display field for displaying an image. A user selectable modification of the image display is provided, where the image may be stepped a predefined column of pixels, or predefined row of pixels, depending on viewing format, at a time at a very slow rate. The image may be stepped a predefined column of pixels per predefined time period until it is entirely to one side of the display, at which point it may be slowly stepped back to the other side of the display.

16 Claims, 5 Drawing Sheets

300

SLOW DITHER DISPLAY

BACKGROUND

Implementations of the claimed invention generally may relate to displays and, more particularly, to image display modes.

Standard NTSC (National Television System Committee) and PAL (Phase Alternation Line) televisions have a picture aspect ratio of 4:3. This means that the ratio of the width of the visible area to the height of the visible area is 4:3, or 1.33. Standard computer-related and television displays have aspect ratios of 1.33:1 while widescreen format displays such as high-definition television (HDTV) displays have aspect ratios of 16:9 visual display (i.e., 1.78:1). In addition, widescreen cinematic displays such as Cinemascope and Super Panavision have aspect ratios of 2.35:1 and 2.55:1, respectively.

Widescreen format displays such as 16:9 visual display format televisions may display 4:3 visual display format programs in an original 4:3 visual display format by utilizing blanking bars 102 at the edges of the display 100 as shown in FIG. 1. In FIG. 1, depiction of the sunset 104 is in original 4:3 visual display format, and the rest of the 16:9 visual display widescreen format is filled with blanking bars 102. Displays 200 having 4:3 visual display format typically may display 16:9 in their original 16:9 visual display format, placing blanking bars 202 above and below the image as shown in FIG. 2. In both cases, there is the possibility of burning in the image of the blanking bars, which during long term viewing may compromise displays. There is also the possibility that logos may be burned in if they appear on the screen.

BRIEF DESCRIPTION OF THE DRAWINGS

The accompanying drawings, which are incorporated in and constitute a part of this specification, illustrate one or more implementations consistent with the principles of the invention and, together with the description, explain such implementations. The drawings are not necessarily to scale, the emphasis instead being placed upon illustrating the principles of the invention. In the drawings.

DETAILED DESCRIPTION

The following detailed description refers to the accompanying drawings. The same reference numbers may be used in different drawings to identify the same or similar elements. In the following description, for purposes of explanation and not limitation, specific details are set forth such as particular structures, architectures, interfaces, techniques, etc. in order to provide a thorough understanding of the various aspects of the claimed invention. However, it will be apparent to those skilled in the art having the benefit of the present disclosure that the various aspects of the invention claimed may be practiced in other examples that depart from these specific details. In certain instances, descriptions of well known devices, circuits, and methods are omitted so as not to obscure the description of the present invention with unnecessary detail.

Embodiments of the invention provide an image display mode for displays, such as a television, that do not use the entire display field for displaying an image. A user selectable modification of the image display is provided, where the image may be stepped a predefined column of pixels, or predefined row of pixels, depending on viewing format, at a time at a very slow rate. For example, the image may be stepped horizontally one column of pixels per minute until it is entirely to the right or left side of the display, at which point it may be slowly stepped back to the opposite side of the display. In another embodiment, the image may be stepped vertically one column of pixels per minute until it is entirely to the top or bottom side of the display, at which point it may be slowly stepped back to the opposite side of the display. One skilled in the art will recognize that embodiments of the invention are not limited to being implemented to step in any particular direction, including horizontally or vertically. For illustrative purposes, however, embodiments are shown and discussed with the image being stepped horizontally in the left and right directions.

Figure 1:
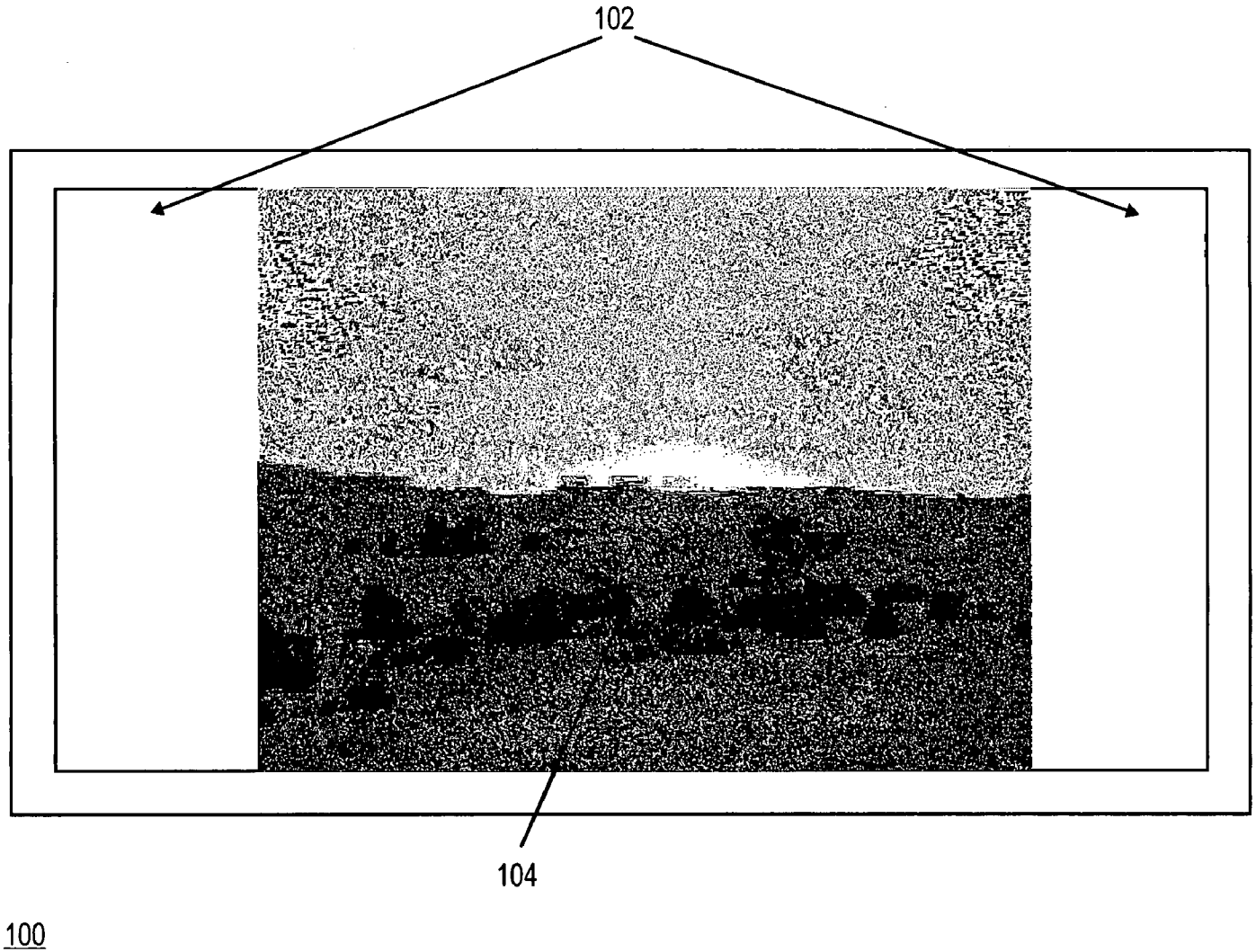
FIG. 1 illustrates an example system.
Figure 2:
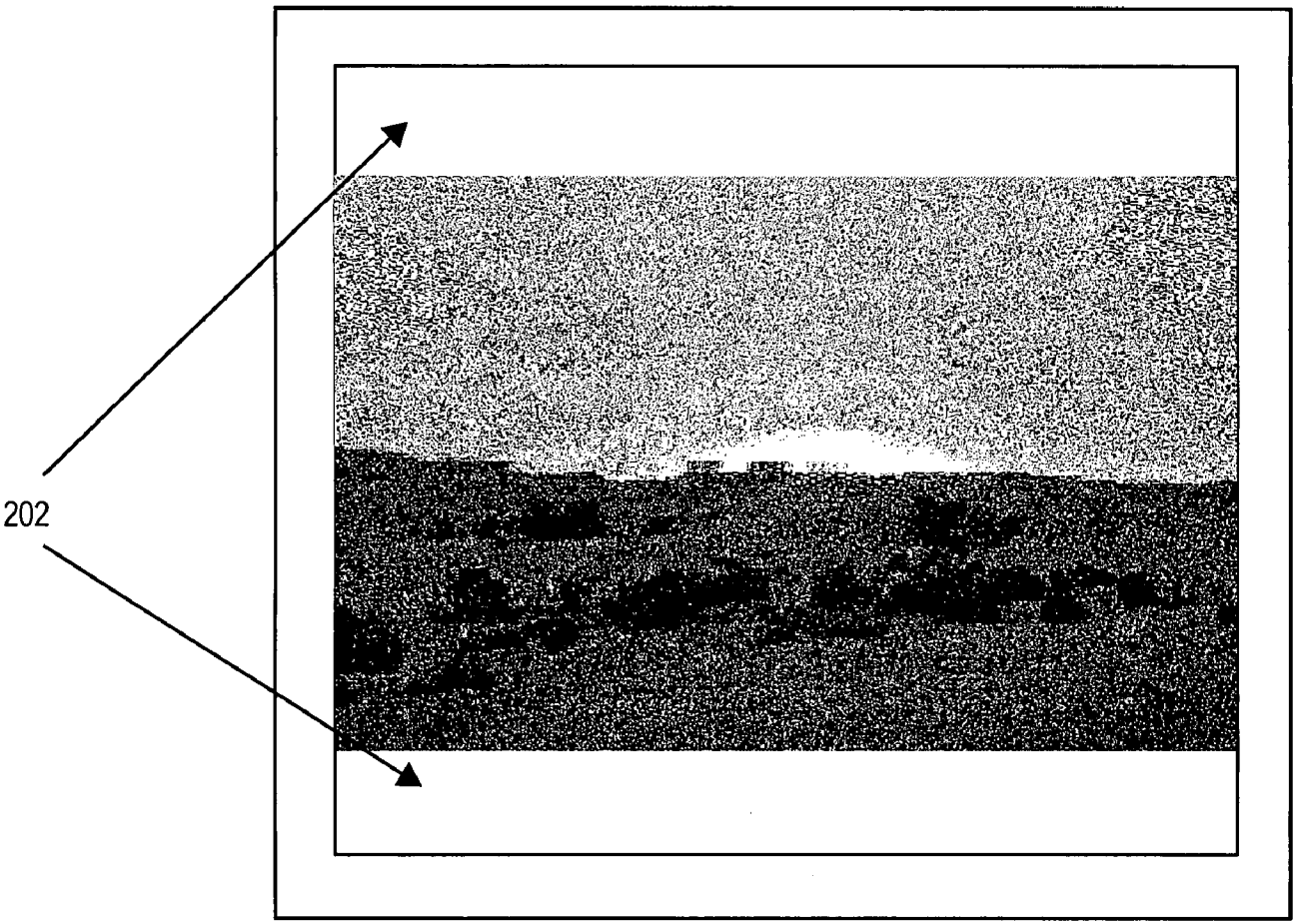
FIG. 2 illustrates another example system.
Figure 3:
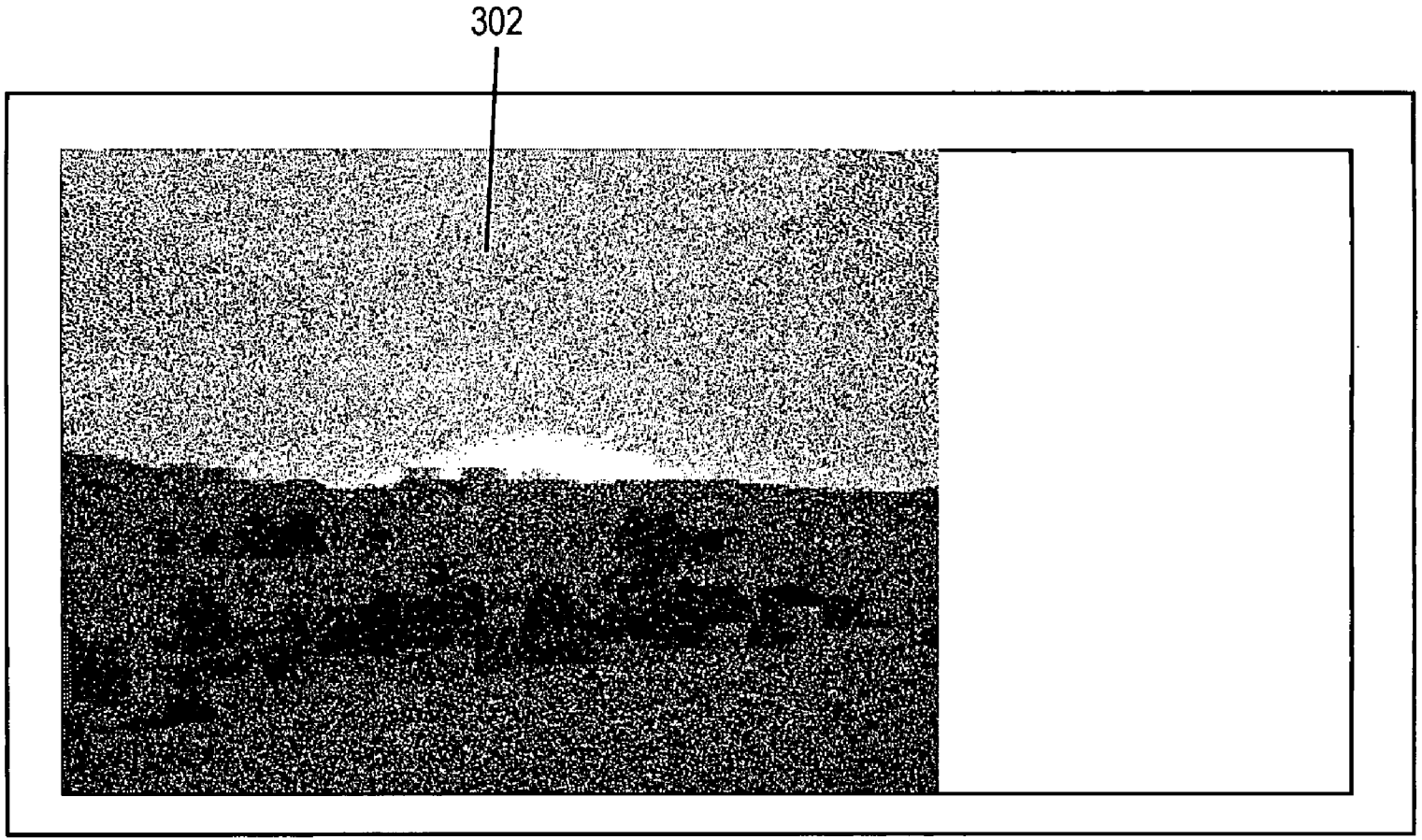
FIG. 3 illustrates an example display when the image has been stepped entirely to the left side of a display.

FIG. 3 illustrates an example display 300 where image 302 has been stepped entirely to the left side of display 300. In particular, the exemplary display is a 16:9 visual display format screen with a 4:3 visual display format image. The image 302 is allowed to dither to the right extent of display 300. The blanking bars 304 are positioned on the right side of the screen. To minimize the blanking bars 304 from burning in, a dithering mode is activated to move image 302 slowly to the left and right on display 300. Image 302 moves back and forth on display 300, from one edge to the next slowly. The amount of time the blanking bars 304 may be at one color extending the life of display 300 is reduced. The step rate is so slow it may be imperceptible to the viewer.

Figure 4:
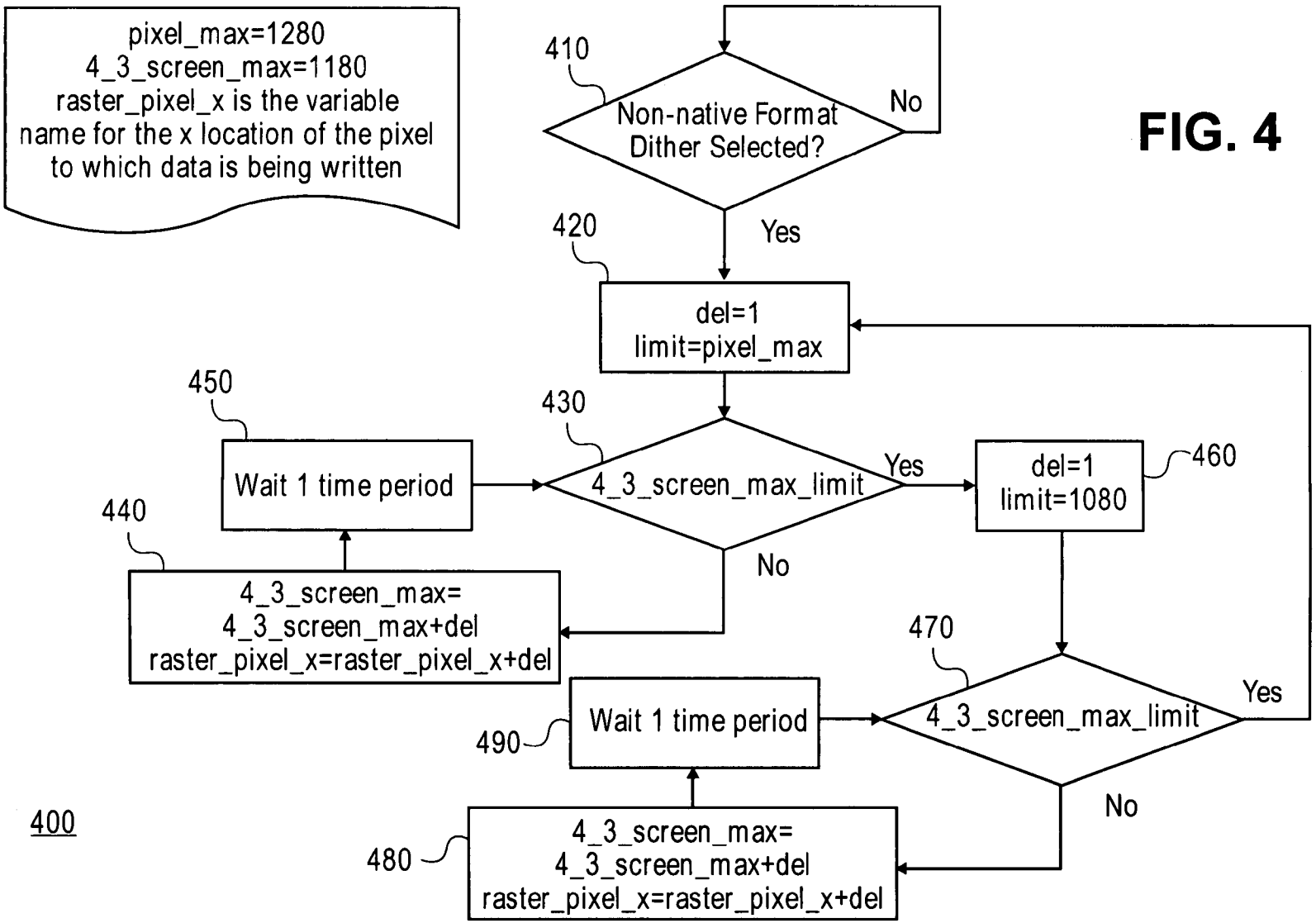
FIG. 4 is a flow chart illustrating a process of viewing a smaller format on a larger display and FIG. 5 illustrates an example system.

FIG. 4 is a flow chart 400 illustrating a process of viewing a smaller format on a larger display. For illustrative purposes, the image format is assumed to be 4:3 visual display, 1080 pixels wide, and the display is assumed to be 16:9 visual display, 1280 pixels wide. A bit map is assumed. For displaying a 4:3 visual display image which uses 1180 of the pixels in width, the image may be stepped at 1 pixel intervals with a wait time in between, for 50 pixels. Once it reaches an edge of the screen, the image is stepped back 100 pixels in the other direction. One skilled in the art will recognize that embodiments of the invention are not limited to the sizes noted above, but rather may be implemented in a variety of image and display sizes of different pixel widths.

In act 410, it is determined whether a non-native format dither has been selected. An end user may select the dither function anytime the user is viewing a display such as a television screen.

If the dither function has been selected, a variable is set to a first value and the limit for the screen is determined (act 420). The appropriate first value will be system dependent. For example, the step size variable "del" is set to 1. The variable "pixel_max" is the limit corresponding to the screen pixel maximum width, for example 1280.

In act 430, it is determined whether the image screen maximum has reached the predefined limit. "4_3_screen_max" in this example is 1180, which is where the edge will be for a 4:3 visual display format of total width 1080, symmetrically placed within a 1280 wide field (center of 1280 is 640, ½ of 1080 is 540, 640+540=1180).

If the image screen maximum has not exceeded the limit, the image screen maximum and raster_pix_x are each incremented by del (act 440). Raster_pixel_x is the x location of the pixel to which data is being written, so the effect is to shift the entire image by del in the x direction. If the image screen maximum has not reached the limit yet, the raster pixel is incremented by the step size del.

In act 450, a wait period occurs and the process returns to act 430. The wait period may typically be one time period. The time period is generally determined by the technology taking into consideration various factors including burn in rate. For example, plasma may burn in at a different rate than a cathode ray tube. A system clock or other time signal may be used. For example, television manufacturers could set the dither rate based on the line voltage of 60 hertz.

Acts 430, 440 and 450 are repeated until the image screen maximum reaches its predefined limit (act 430).

Eventually the image reaches the extent of the screen which is detected when 4_3_screen_max reaches the limit (act 430). As previously noted, the variable "pixel_max" is the limit corresponding to the screen pixel maximum width, for example 1280.

In act 460, the step size is set to a value that is used to reverse the path of the image. For example, the step size del is set to −1, and the new limit becomes the image width, in this example 1080. One skilled in the art will recognize that these values will be system dependent and are provided for exemplary purposes. In accordance with embodiments of the invention, when the limit is reached on one side of the screen, the step size delta is set to a value that reverses the direction, such as −1.

In act 470, it is determined whether the image screen_max has reached the limit.

If the image screen_max has not exceeded the limit, the image screen_max and raster_pix_x are each incremented by the step size delta (act 480).

In act 490, a wait period occurs and the process returns to act 430.

Eventually the image reaches the extent of the screen which is detected when 4_3_screen_max reaches the limit (act 470). The process returns to act 420. In particular, the raster_pixel_x begins to decrement as does 4_3_screen_max until the image is now to the other extent of the screen, again detected when 4_3_screen_max is equal to limit. The process continues until the user exits the slow dither mode. For example, if image screen max has not reached the predefined limit, the step size 1 is subtracted from 1280, and then 1279 until the 1080 limit is reached. At that point, the image is at the other end of the limit, and the step size delta is changed back to 1. The limit is changed back to the initial limit and the process starts over again. As a result, the blanking bar may be consistent in color, hence consistent in contrast to the image. Embodiments of the invention only require the user to alter which portion of the screen they are looking at.

The foregoing description of one or more implementations provides illustration and description, but is not intended to be exhaustive or to limit the scope of the invention to the precise form disclosed. Modifications and variations are possible in light of the above teachings or may be acquired from practice of various implementations of the invention.

For example, although the slow dither scheme herein has been described with regard to 4:3 format images and 16:9 format displays, it is applicable to images and displays of various sizes. Moreover, the acts in FIG. 4 need not be implemented in the order shown; nor do all of the acts necessarily need to be performed. Also, those acts that are not dependent on other acts may be performed in parallel with the other acts. Further, at least some of the acts in this figure may be implemented as instructions, or groups of instructions, implemented in a machine-readable medium.

Figure 5:
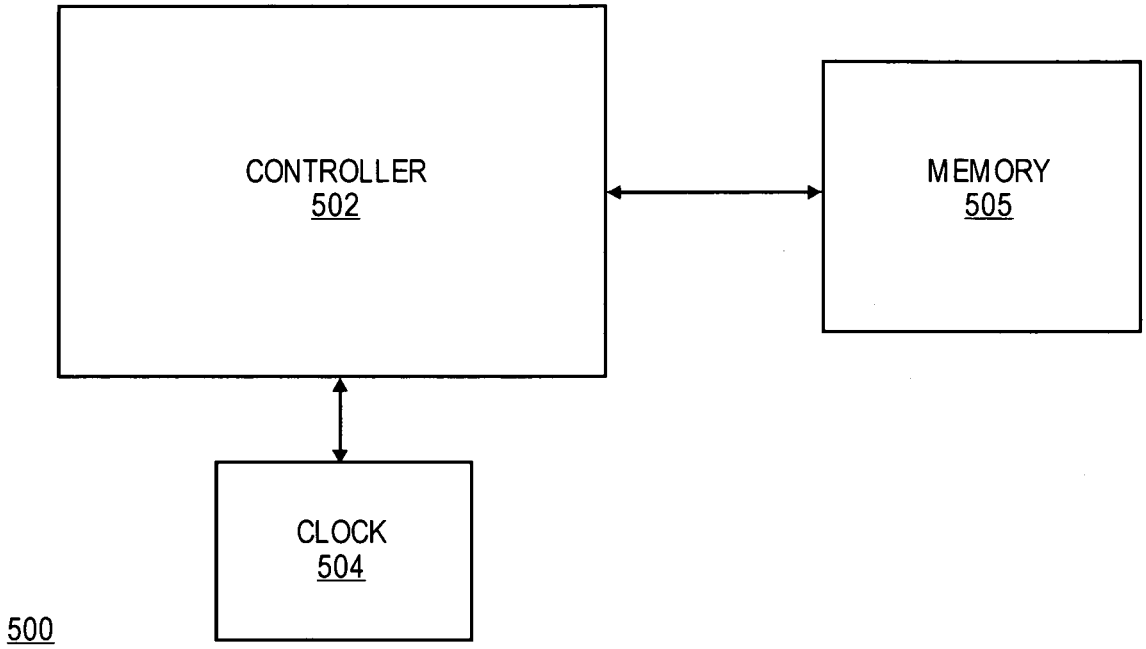

FIG. 5 illustrates an example system 500 including image display controller 502, clock 504 and memory 506. In the case of a bit-mapped display, such as a LCD or plasma display, control will be provided by software implemented by controller 502 and clock 504. In other implementations, control may be implemented in hardware or a combination of hardware and software. The process calculates which field of pixels is to be used at the given moment in time. In particular, the X and Y values may be used to calculate which pixel is to be which color is adjusted. In the case of steering an electron beam, the voltage used to direct the beam will be adjusted, using a calculation of the new X and Y values. As previously noted, a wait period occurs may typically be one time period. The time period is generally determined by the technology taking into consideration various factors including burn in rate. A clock 504 such as system clock or other time signal may be used. Memory 506 may be used to store values such as set values.

No element, act, or instruction used in the description of the present application should be construed as critical or essential to the invention unless explicitly described as such. Also, as used herein, the article "a" is intended to include one or more items. Variations and modifications may be made to the above-described implementation(s) of the claimed invention without departing substantially from the spirit and principles of the invention. All such modifications and variations are intended to be included herein within the scope of this disclosure and protected by the following claims.

What is claimed:

1. A method for enabling viewing of a smaller format image on a larger format display, comprising:

determining that a user has selected a dither function;

in response to the dither function being selected, determining image position on the display, display limits and a predefined step size; and moving the image across the display at intervals according to the predefined step size until the user exits the dither function, wherein the predefined step size is based on a line frequency, and wherein the image movement is imperceptible to viewers.

2. The method claimed in claim 1, wherein moving the image across the display at intervals according to the predefined step size, wherein the image movement is imperceptible to viewers further comprises:

stepping the image a predefined column of pixels, or predefined row of pixels, depending on viewing format, at a time at a predefined rate.

3. The method claimed in claim 2, wherein stepping the image a predefined column of pixels, or predefined row of pixels, depending on viewing format, at a time at a predefined rate further comprises:

stepping the image a predefined column of pixels per time period until it is entirely to one side of the display, at which point it may be slowly stepped back to the opposing side of the display and repeated until deactivated.

4. The method claimed in claim 3, wherein moving the image across the display at intervals according to the predefined step size further comprises:

moving the image across the display horizontally at intervals according to the predefined step size.

5. The method claimed in claim 3, wherein moving the image across the display at intervals according to the predefined step size further comprises:

moving the image across the display vertically at intervals according to the predefined step size.

6. A computer-readable medium encoded with instructions capable of being executed by a computer, cause a computer to:

determine that a user has selected a dither function;

in response to the dither function being selected, determine image position on the display, display limits and a predefined step size; and move the image across the display at intervals according to the predefined step size until the user exits the dither function, wherein the predefined step size is based on a line frequency, and wherein the image movement is imperceptible to viewers.

7. The computer-readable medium claimed in claim 6, wherein instructions to move the image across the display at intervals according to the predefined step size, wherein the image movement is imperceptible to viewers further comprises instructions that, when executed, cause the machine to:

step the image a predefined column of pixels, or predefined row of pixels, depending on viewing format, at a time at a predefined rate.

8. The computer-readable medium claimed in claim 7, wherein instructions to step the image a predefined column of pixels, or predefined row of pixels, depending on viewing format, at a time at a predefined rate further comprises instructions that, when executed, cause the machine to:

step the image a predefined column of pixels per time period until it is entirely to one side of the display, at which point it may be slowly stepped back to the opposing side of the display and repeated until deactivated.

9. The computer-readable medium claimed in claim 8, wherein instructions to move the image across the display at intervals according to the predefined step size further comprises instructions that, when executed, cause the machine to:

move the image across the display horizontally at intervals according to the predefined step size.

10. The computer-readable medium claimed in claim 8, wherein instructions to move the image across the display at intervals according to the predefined step size further comprises instructions that, when executed, cause the machine to:

move the image across the display vertically at intervals according to the predefined step size.

11. An apparatus, comprising:

a display device to determine that a user has selected a dither function and in response to the dither function being selected, to determine image position on the display, display limits and a predefined step size and move the image across the display at intervals according to the predefined step size until the user exits the dither function, wherein the predefined step size is based on a line frequency, and wherein the image movement is imperceptible to viewers.

12. The apparatus claimed in claim 11, wherein the display device further steps the image a predefined column of pixels, or predefined row of pixels, depending on viewing format, at a time at a predefined rate.

13. The apparatus claimed in claim 12, wherein the display device steps the image a predefined column of pixels per time period until it is entirely to one side of the display, at which point it may be slowly stepped back to the opposing side of the display and repeated until deactivated.

14. A system comprising:

a memory;

a clock; and a controller to determine that a user has selected a dither function and in response to the dither function being selected, to determine image position on the display, display limits and a predefined step size and move the image across the display at intervals according to the predefined step size until the user exits the dither function, wherein the predefined step size is based on a line frequency, and wherein display parameters are stored in memory and step size is determined in accordance with the clock.

15. The system claimed in claim 14, wherein the controller further steps the image a predefined column of pixels, or predefined row of pixels, depending on viewing format, at a time at a predefined rate.

16. The system claimed in claim 15, wherein the controller steps the image a predefined column of pixels per time period until it is entirely to one side of the display, at which point it may be slowly stepped back to the opposing side of the display and repeated until deactivated.

* * * * *